US010610011B1

(12) United States Patent
Greenhill

(10) Patent No.: US 10,610,011 B1
(45) Date of Patent: Apr. 7, 2020

(54) PORTABLE TABLETOP LECTERN SUITABLE FOR MASS-MANUFACTURE

(71) Applicant: Keith Rodney Greenhill, Hoover, AL (US)

(72) Inventor: Keith Rodney Greenhill, Hoover, AL (US)

(73) Assignee: Keith Greenhill, Birmingham, AL (US)

( * ) Notice: Subject to any disclaimer, the term of this patent is extended or adjusted under 35 U.S.C. 154(b) by 0 days.

(21) Appl. No.: 16/163,564

(22) Filed: Oct. 17, 2018

(51) Int. Cl.

| | |
|---|---|
| ***A47B 23/04*** | (2006.01) |
| ***A47B 47/04*** | (2006.01) |
| ***A47B 19/00*** | (2006.01) |
| ***A47B 19/08*** | (2006.01) |
| *A47B 43/00* | (2006.01) |
| *A47C 4/02* | (2006.01) |
| *A47B 3/06* | (2006.01) |
| *A47B 13/00* | (2006.01) |

(52) U.S. Cl.
CPC ..... *A47B 23/043* (2013.01); *A47B 19/00* (2013.01); *A47B 19/08* (2013.01); *A47B 23/042* (2013.01); *A47B 47/042* (2013.01); *A47B 3/06* (2013.01); *A47B 13/003* (2013.01); *A47B 43/00* (2013.01); *A47B 2230/0085* (2013.01); *A47C 4/021* (2013.01)

(58) Field of Classification Search
CPC ..... A47B 19/00; A47B 19/08; A47B 23/042; A47B 13/003; A47B 3/06; A47B 47/047; A47B 47/06; A47B 2230/0085; A47B 47/042; A47B 3/12; A47B 47/0075; A47B 43/00; A47B 2220/0086; A47C 4/021
USPC ..... 248/448, 459, 460, 174; 108/180, 108/157.16, 157.1, 158.12
See application file for complete search history.

(56) References Cited

U.S. PATENT DOCUMENTS

| | | | | |
|---|---|---|---|---|
| 1,675,060 A * | 6/1928 | Simmons | B41J 29/15 | 248/459 |
| 2,188,602 A * | 1/1940 | Hall | A47B 19/08 | 248/459 |
| 3,056,230 A * | 10/1962 | Brokaw, Jr. | A47B 19/08 | 248/460 |
| 3,410,441 A * | 11/1968 | Rhyne | A47B 88/941 | 220/4.28 |
| 3,722,971 A * | 3/1973 | Zeischegg | A47B 47/042 | 312/107 |
| 3,807,572 A * | 4/1974 | Luvara | A47B 47/042 | 211/10 |
| 3,885,762 A * | 5/1975 | Sebastiani | G12B 9/08 | 248/346.07 |

(Continued)

*Primary Examiner* — Hiwot E Tefera
*Assistant Examiner* — Taylor L Morris

(57) ABSTRACT

A lightweight portable lectern consisting of four pieces designed to be assembled together without the use of tools provides a lecture or presentation aid suitable for traveling, but also provides a design suitable for mass-manufacturing processes such as injection molding. The four pieces consist of two side members—a left side member and a right side member—along with a top member and a front member. The top member has two openings on the bottom surface—one near the left edge, the other near the right edge. Each of the side members has a protrusion from the upper edge, designed to fit into the appropriate opening on the bottom surface of the top member. The front member has protrusions from the rear surface which are designed to fit into openings at the front edge of the two side members.

5 Claims, 5 Drawing Sheets

(56) References Cited

U.S. PATENT DOCUMENTS 3,885,845 A * 5/1975 Krieks ..... A47B 47/042 312/265
4,188,067 A * 2/1980 Elmer ..... A47C 4/021 297/440.13
4,484,787 A * 11/1984 Stephens ..... A47B 19/08 108/60
4,595,105 A * 6/1986 Gold ..... A47B 65/00 108/60
4,618,120 A * 10/1986 Wattles ..... F16B 12/20 211/189
4,869,564 A * 9/1989 Lechman ..... A47B 13/003 312/195
4,875,418 A * 10/1989 Moeckl ..... A47B 3/06 108/50.02
4,883,331 A * 11/1989 Mengel ..... A47B 13/003 312/195
5,088,678 A * 2/1992 Bitan ..... A47B 97/04 248/441.1
5,315,935 A * 5/1994 Weisenfels ..... A47B 3/10 108/115
5,357,728 A * 10/1994 Duncanson ..... B27F 1/00 52/592.4
5,472,098 A * 12/1995 Ho ..... A47B 23/042 211/189
5,478,145 A * 12/1995 Kamachi ..... F16B 12/12 108/107
5,537,793 A * 7/1996 Murasaki ..... A44B 18/00 24/306
5,702,011 A * 12/1997 Carroll ..... A47B 47/042 108/180
5,735,411 A * 4/1998 Flamme ..... H02B 1/30 108/180
5,921,646 A * 7/1999 Hwang ..... F16B 5/0642 312/249.8
5,954,412 A * 9/1999 Rutherford ..... A01K 63/003 108/157.15
6,010,262 A * 1/2000 Linyear ..... A47B 21/0314 248/441.1
6,397,781 B1 * 6/2002 Bellington ..... A01K 31/14 119/431
6,491,278 B1 * 12/2002 Thomsen ..... A47B 23/042 108/180
6,513,443 B2 * 2/2003 Todd ..... A47B 19/08 108/115
6,557,811 B1 * 5/2003 Burns ..... A47B 23/044 248/455
6,557,955 B2 * 5/2003 Saravis ..... A47B 47/0033 312/111
6,827,028 B1 * 12/2004 Callaway ..... A47B 3/06 108/158.12
6,883,882 B2 * 4/2005 Lin ..... A47B 47/042 108/101
7,278,621 B1 * 10/2007 Bareis ..... A47B 97/04 248/441.1
7,533,940 B1 * 5/2009 Zook ..... A47B 83/02 297/440.13
7,631,605 B2 * 12/2009 Willy ..... A47B 13/003 108/157.16
7,998,549 B2 * 8/2011 Susnjara ..... A47B 47/042 29/428
8,113,605 B2 * 2/2012 Ceballos-Godefroy ..... A47F 5/10 312/262
8,220,398 B1 * 7/2012 Brandenberg ..... A47B 3/06 108/158.12
8,267,477 B1 * 9/2012 Appiah Finn ..... A47C 16/025 108/115
8,936,226 B2 * 1/2015 Chang ..... A47B 19/00 108/155
9,089,206 B2 * 7/2015 Baylor ..... A47B 19/08
2002/0100398 A1 * 8/2002 Santini ..... A47B 23/042 108/157.1
2002/0189508 A1 * 12/2002 Todd ..... A47B 19/08 108/115
2006/0103089 A1 * 5/2006 Decoste ..... A47B 19/00 280/47.34
2008/0011203 A1 * 1/2008 Anderson ..... A47B 19/00 108/50.01
2008/0149006 A1 * 6/2008 Leng ..... A47B 3/08 108/121
2008/0245281 A1 * 10/2008 Willy ..... A47B 13/003 108/157.16
2009/0284111 A1 * 11/2009 Hazzard ..... A47B 3/06 312/265.6
2009/0302046 A1 * 12/2009 Roberts, Sr. ..... B65D 19/18 220/666
2010/0173122 A1 * 7/2010 Susnjara ..... A47B 47/042 428/119
2010/0253195 A1 * 10/2010 Owens ..... A47B 47/042 312/351.2
2011/0095579 A1 * 4/2011 Hill ..... A47C 7/725 297/217.1
2012/0080910 A1 * 4/2012 Davis ..... A47B 47/0075 297/118
2012/0152178 A1 * 6/2012 McLean ..... A01K 31/08 119/431
2014/0048176 A1 * 2/2014 Susnjara ..... A47B 47/042 144/344
2014/0205373 A1 * 7/2014 Andersson ..... F16B 12/125 403/364
2014/0373357 A1 * 12/2014 Elliott ..... B23P 11/00 29/897
2015/0147113 A1 * 5/2015 Crabtree, II ..... A47B 13/021 403/292
2016/0136535 A1 * 5/2016 Heston ..... A63H 33/084 446/108
2017/0227031 A1 * 8/2017 Boo ..... A47B 88/941
2018/0035799 A1 * 2/2018 Leafgren ..... A47B 23/00

* cited by examiner

PORTABLE TABLETOP LECTERN SUITABLE FOR MASS-MANUFACTURE

BACKGROUND OF THE INVENTION

Field of the Invention

The technical field of the invention relates to podiums, lecterns, pulpits, or platforms for use in activities such as giving a lecture or presentation, and onto which books, notes, papers, laptop, tablet, or other items related to the presentation would typically be placed; and, more specifically, to such a lectern that is of a height suitable for use when placed on an object such as a table.

Description of Prior Art

A podium or lectern is an almost essential aid for giving a lecture or presentation. The challenge is to design a podium that is portable and can be easily assembled, but is also of a suitable design to facilitate production using mass-manufacturing processes such as injection molding.

A tabletop lectern like U.S. Pat. No. 6,4191,278 B1 consists primarily of four similar members and also does not use fasteners like screws or hinges for assembly. However, though this lectern claims to require no separate attachment devices, it requires hook and loop tape or a hinge mechanism for assembly; the present invention truly requires only the four pieces (top, sides and front) for assembly. The lectern of U.S. Pat. No. 6,491,278 B1 is also not designed for a mass-manufacturing process like injection molding, but likely requiring the individual pieces to be cut from sheets of material such as cardboard or foam core panels. Another difference between this lectern and the present invention is that the lectern of U.S. Pat. No. 6,491,278 B1 describes a back member (in addition to the top, side and front members), and states that this back member has an inclined orientation in assembly due to the trapezoidal form of the side members. The present invention only consists of the four pieces (top, sides and front), with only the top member being in an inclined orientation in the assembled condition.

Most portable tabletop lecterns for which patents have previously been granted are primarily of the following type: foldable lecterns consisting of multiple pieces which are fixed together by metal parts such as screws and/or hinges. Examples of these include the following: U.S. Pat. Nos. 6,513,443; 5,224,768; D320,319; U.S. Pat. Nos. 4,258,833; 4,166,926; D457,011; patent D306,535; patent D206,755; patent D210,670; patent D144,202. Lecterns such as these require tools for assembly; they are portable, but are not designed for mass-manufacture and not necessarily designed for ease of assembly and disassembly. These are also typically of relatively complex design.

There are also lecterns that can be disassembled when not in use, but when in use, whose individual component pieces are held together in assembly by rails or fasteners. Examples of these include the following: U.S. Pat. Nos. 4,466,593; 4,618,120. Lecterns such as these typically have a relatively large number of parts, some of which are small and easily misplaced, and are also not designed for mass-manufacture.

There are lecterns that are designed for easy portability, but when in use would keep the height of the presenter's material at the same height as the object on which the lectern was placed—requiring the presenter to look farther to see his notes, or to arrange for something taller than a typical table on which to place the portable lectern. Examples of this are U.S. Pat. Nos. 4,607,817, 4,623,276, and 3,129,032.

There are also lecterns that are neither foldable nor able to be disassembled, but whose composite pieces are affixed together. An example of this is patent D392,474. These lecterns are not suited for portability—such as being able to be placed into a typical carry-on suitcase or briefcase.

There are lecterns that are designed for ease of manufacturing—through processes such as thermoforming—and ease of assembly/disassembly, and also could be small enough to fit into a carry-on suitcase or briefcase. An example of this is U.S. Pat. No. 5,480,119. Lecterns such as these are not necessarily designed for large-volume, mass-manufacturing production runs, and have small pieces that could be easily misplaced during disassembly. Lecterns like U.S. Pat. No. 5,480,119, due to the height of the side-panels which act as a windscreen for papers resting on the shelf, would be either too narrow for objects such as a laptop or three-ring binder to lay flat, or—if wide enough to allow objects such as a laptop or three-ring binder to lay flat—would be too large to fit into a typical briefcase or carry-on suitcase.

There are numerous full-height podiums or stands that are also collapsible, such as U.S. Pat. Nos. 3,861,328, 3,365, 328, and 5,152,491. These podiums or stands are not small enough when collapsed to enable them to be placed into a carry-on suitcase or briefcase, and are of relatively complex design—typically with metal parts like hinges and screws, requiring the use of a tool for assembly and disassembly.

SUMMARY OF THE INVENTION

The portable lectern of this invention is designed so that the four individual members (top, sides and front) are interconnected and self-sufficient components of a unit, that unit being the assembled lectern.

It is not only the number of members of this invention nor their names; not just the fact of which surface or edge of a member abuts another member's surface or edge; not the fact that the members connect to each other using protrusions that fit into provided openings of other members. Rather, it is the fact that this invention is designed in such a way that the members themselves in their original form (immediately after being manufactured) can be assembled into the lectern. The four members of this invention are interconnected.

Also, these four members are all that is required to enable the user to have a tabletop lectern available for traveling. No tools required; no external fastening devices required. The four members of this invention are self-sufficient.

This design enables a manufacturer to use a process like injection molding to create the individual members at a likely rate of several per minute, with each piece being immediately ready to use.

In these above-described factors, this invention is unique.

This portable lectern does not have any metal parts like screws or hinges, and requires the use of no tool for assembly; it is portable, and designed to fit in a standard carry-on suitcase or briefcase when disassembled; it requires no glue or similar substance to hold the individual pieces together in assembly, enabling it to be disassembled for easy transport; it is designed to be used by being placed on a table or other similar height object, with the top of the lectern held at typical podium height by the lectern side members; its top member is supported by the side members, which are actually underneath the top member when in assembly, enabling rather wide objects like a laptop or three-ring binder to lay flat on the top member's top surface—even though the top member may be narrower than the object that is placed on it; it is designed for mass-manufacture, using processes like injection molding or 3D printing, but could be produced by other methods.

DETAILED DESCRIPTION

Figure 1:
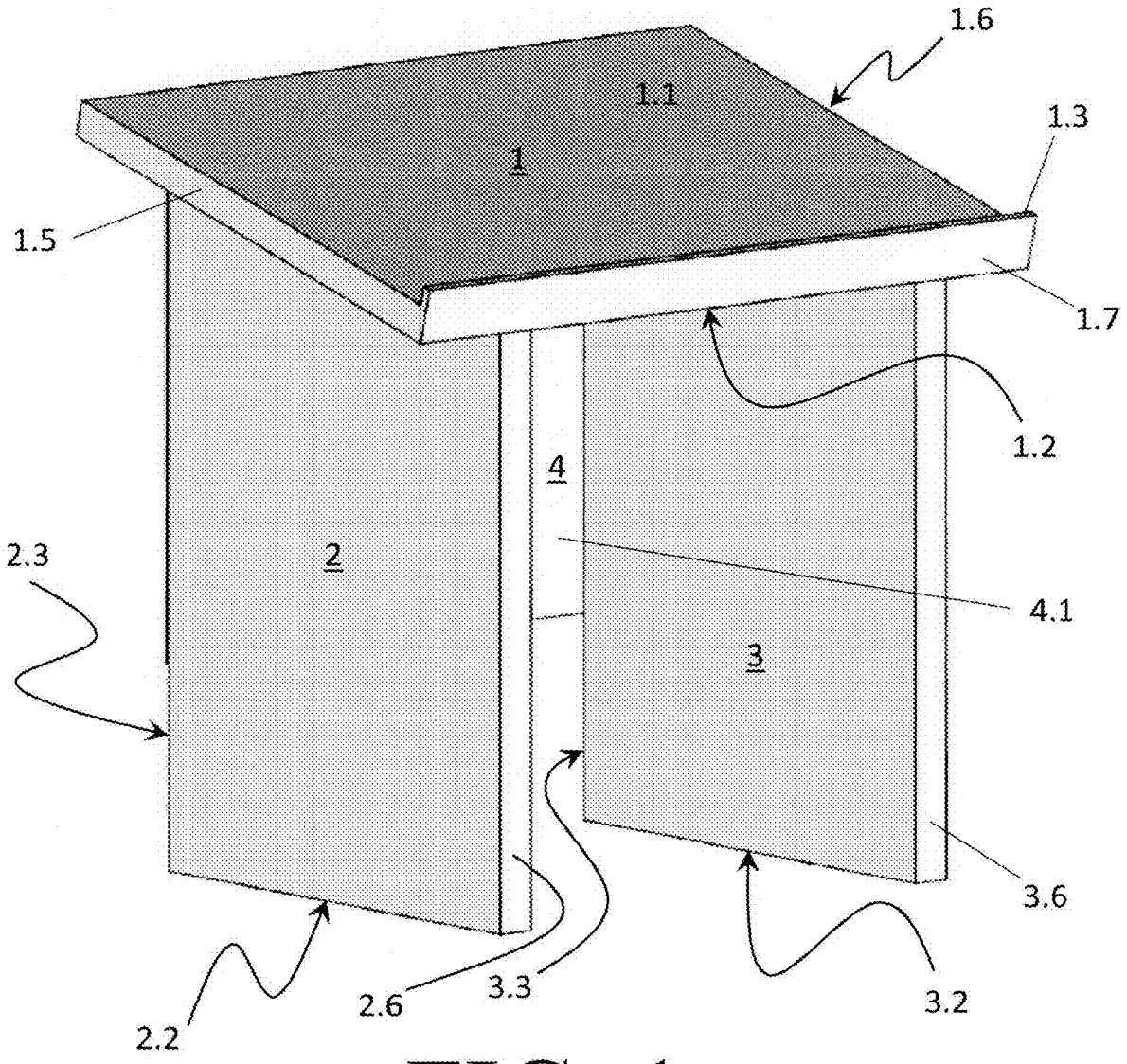
FIG. 1 shows the portable lectern of the present invention in assembled form from a top-rear-left-side perspective, with the side members shown on the left and right, the top member above and with bottom surface abutting the upper edge of the side members, and the front member only slightly visible but with rear surface abutting the front edge of the side members.

Referring to the drawings, FIG. 1 shows the lightweight portable lectern of the present invention in assembled form, as it would rest on a surface. When positioned on the top surface 1.1 of top member 1, materials or notes used for the presentation or lecture are prevented from sliding off the rear of the lectern by the raised protrusion 1.3 along the rear edge 1.7 of the top member.

Figure 2:
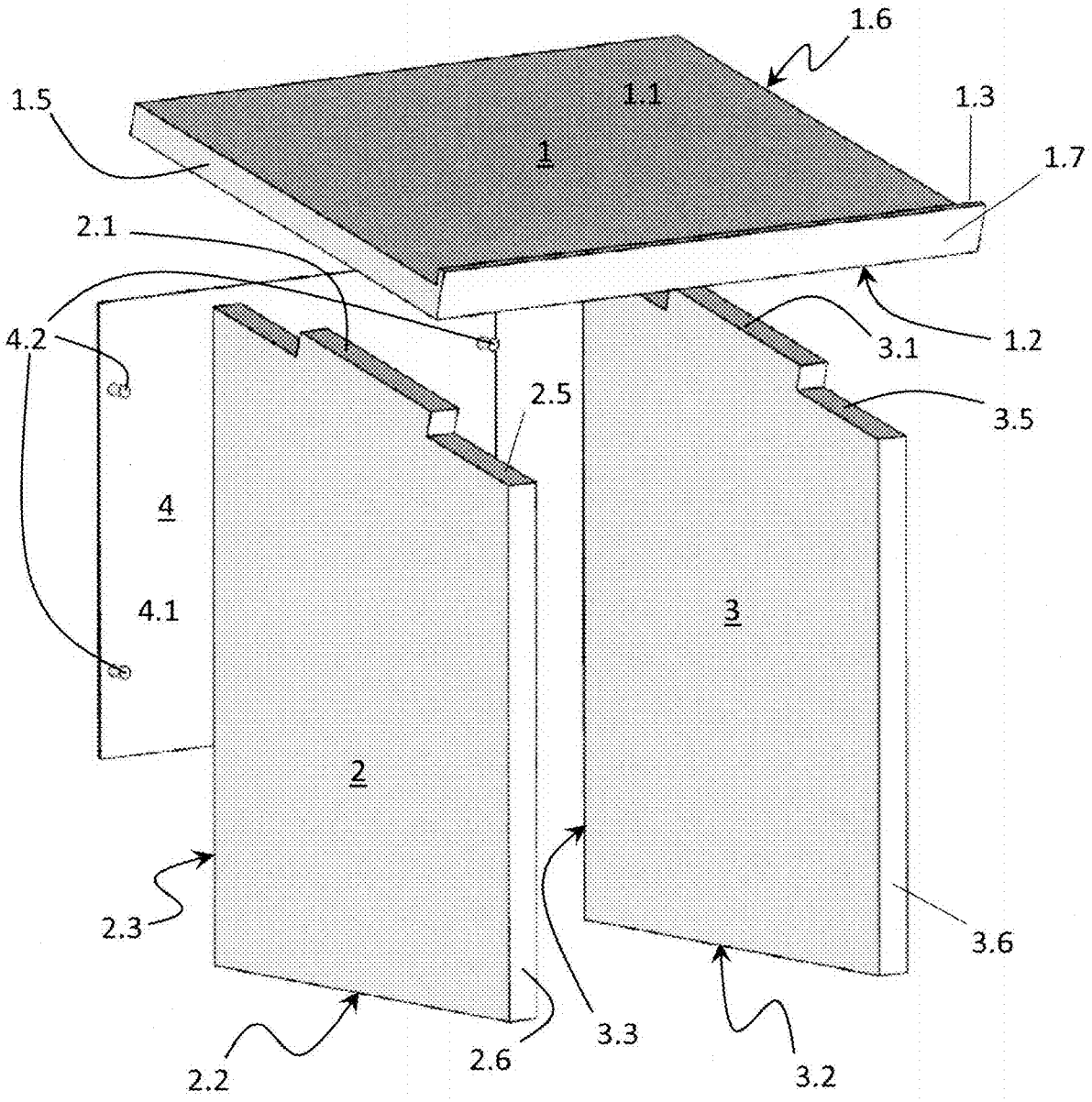
FIG. 2 is a view of the invention from the same upper-rear-left-side perspective as FIG. 1, showing an exploded, plan view of the four parts of the portable lectern, with the protrusions on the upper edge of the side members and the protrusions on the rear surface of the front member visibly indicated.

As illustrated in FIG. 2, the lectern consists of four flat members that can be stacked and stored for transport: a top member 1, a front member 4, a left side member 2 and a right side member 3. The side members 2, 3 are designed so that the length of the side member front edges 2.3, 3.3 respectively is greater than the length of the side member rear edges 2.6, 3.6 respectively, causing the top member 1 to have an inclination in the assembled condition.

Figure 3:
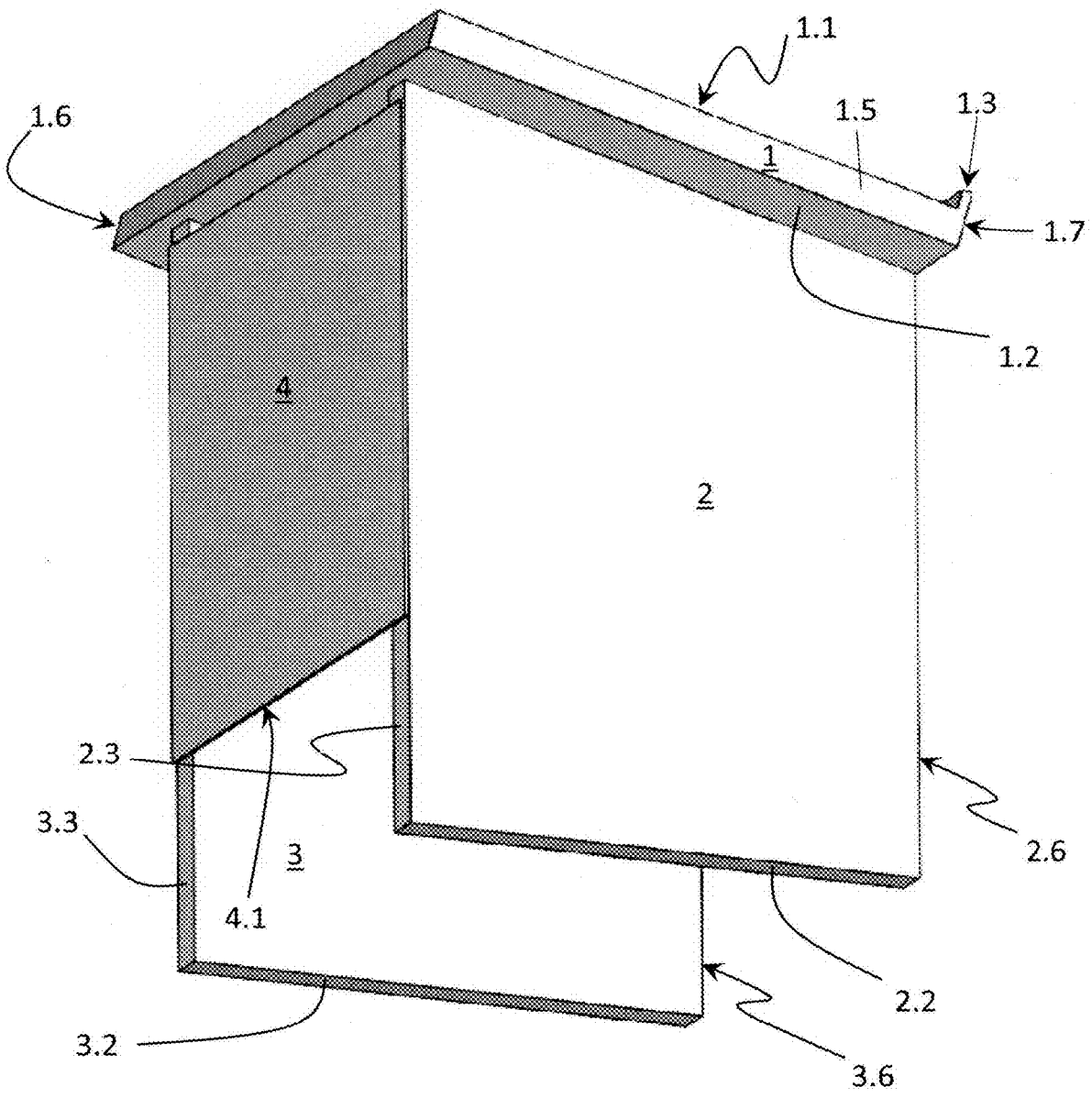
FIG. 3 shows the portable lectern of the present invention in assembled form from a lower-front-left-side perspective, with the left side member in the foreground and the right side member in the background, the top member above and with bottom surface abutting the upper edge of the side members, and the front member shown with rear surface abutting the front edge of the side members.
Figure 4:
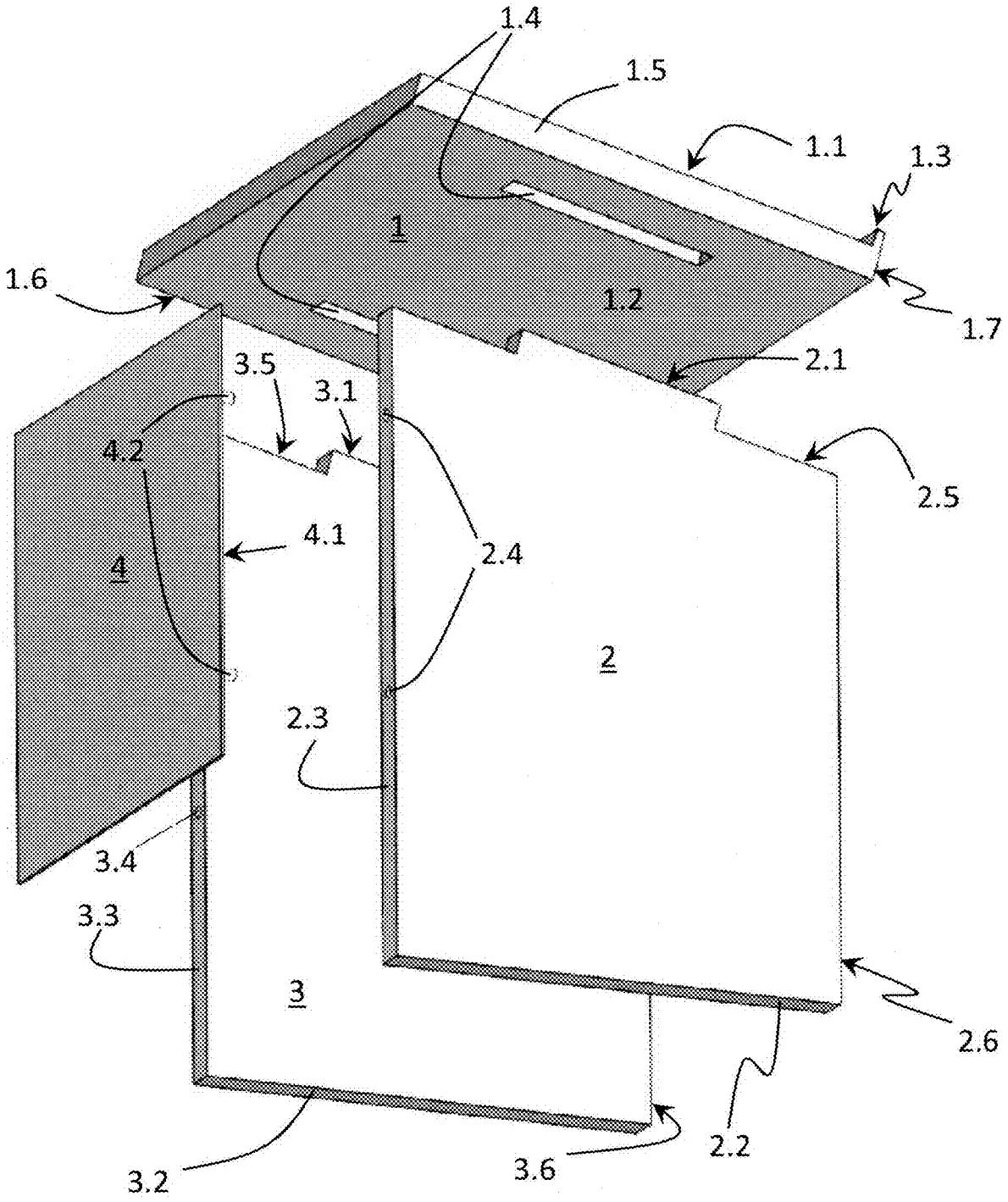
FIG. 4 is a view of the invention from the same lower-front-left-side perspective as FIG. 3, showing an exploded, plan view of the four parts of the portable lectern, visibly indicating the protrusions on the upper edge of the side members, the openings on the bottom surface of the top member into which the protrusions on the upper edge of the side members fit, the protrusions on the rear surface of the front member, and the openings on the front edge of the side members into which the protrusions on the rear surface of the front member fit.
Figure 5:
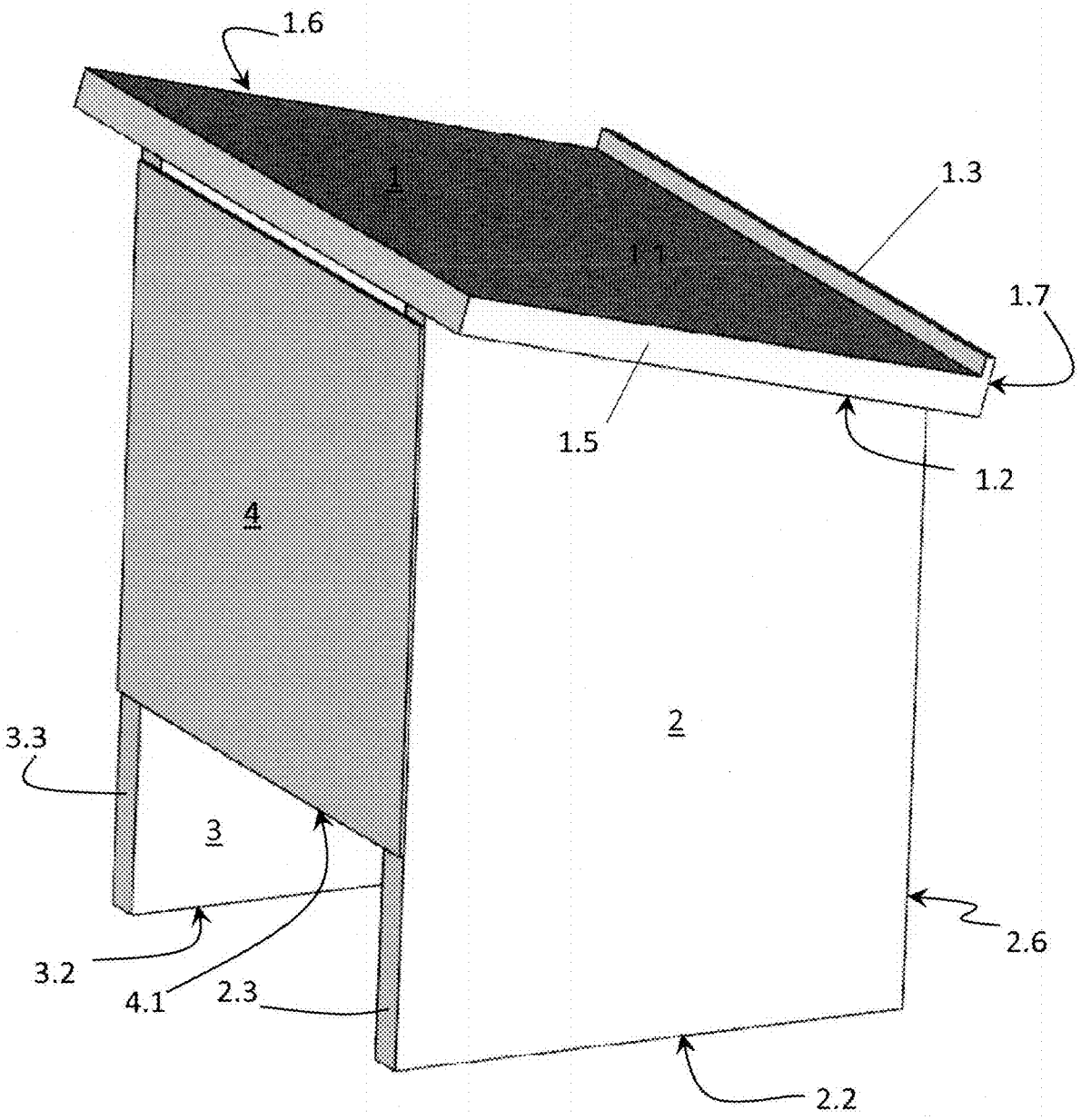
FIG. 5 shows the portable lectern of the present invention in assembled form from a top-front-left-side perspective, with the left side member in the foreground and the right side member in the background, the top member above and with bottom surface abutting the upper edge of the side members, and the front member rear surface abutting the front edge of the side members.

FIGS. 3 and 4 show the lectern from a more front-oriented and underneath-oriented view, with FIG. 3 showing the lectern in assembled state and FIG. 4 showing an exploded, plan view of the lectern. Additionally, FIG. 4 visibly indicates the protrusions 2.1, 3.1 from the upper edge 2.5, 3.5 respectively of the side members 2, 3 respectively, the openings 1.4 in the bottom surface 1.2 of the top member 1, the protrusions 4.2 on the rear surface 4.1 of the front member 4, and the openings 2.4, 3.4 in the front edge 2.3, 3.3 respectively of the side members 2, 3 respectively.

The members of the assembly are releasably secured to one another in the assembled condition by protrusions 4.2 on the rear surface 4.1 of front member 4 being placed into openings 2.4 in the front edge 2.3 of left member 2 and openings 3.4 in the front edge 3.3 of right member 3, and by protrusion 2.1 from the upper edge 2.5 of left member 2 being placed into opening 1.4 near the left edge 1.5 in the bottom surface 1.2 of top member 1, and protrusion 3.1 from the upper edge 3.5 of right member 3 being placed into opening 1.4 near the right edge 1.6 in the bottom surface 1.2 of top member 1. The protrusions indicated previously fit snugly into the corresponding openings, providing stability for the lectern when assembled.

The four parts of the lectern may be formed of any material such as would be appropriate for injection molding or 3D printing, but are not limited to such specific materials.

The lectern is assembled by pressing protrusion 2.1 of left side member 2 upper edge 2.5 into corresponding opening 1.4 in the bottom surface 1.2 near the left edge 1.5 of top member 1, and by pressing protrusion 3.1 of right side member 3 upper edge 3.5 into corresponding opening 1.4 in the bottom surface 1.2 near the right edge 1.6 of top member 1, and by pressing protrusions 4.2 of front member 4 rear edge 4.1 into openings 2.4 in left side member 2 front edge 2.3 and openings 3.4 in right side member 3 front edge 3.3.

Though the portable lectern of this invention is designed to be small enough in disassembled form to allow the four pieces to fit into a briefcase or carry-on suitcase, the height of the lectern is not specified, nor are the dimensions of the individual members. This portable lectern design could accommodate numerous heights or sizes of the individual members, and in assembled condition could be of multiple heights to accommodate persons of different height ranges.

This portable lectern is used as an aid to a standing person (a "speaker") giving presentations, workshops or lectures in which the speaker uses notes. A lectern such as this invention is useful when the only available surface on which to place notes is of the approximate height of a tabletop. For a standing person of average height, notes placed on a tabletop can be difficult to see clearly. This invention enables the notes to be placed at a more appropriate height for viewing.

Once the lectern is fully assembled, the speaker would place notes for the presentation, workshop or lecture onto the top surface 1.1 of top member 1. The lectern of this invention is designed to cause the notes to be angled slightly downward toward the speaker to help the speaker see the notes more easily, and with raised protrusion 1.3 near the rear edge 1.7 of top member 1 providing positional stability of the speaker's notes. This portable lectern provides an acceptable support surface for notes in various forms, including loose pages, spiral notebook, sheets of paper contained in a binder, or notes stored on an electronic device such as a cell phone, notepad or laptop.

This invention design—especially when manufactured by a process such as injection molding—can provide a lightweight but stable surface for notes as described above. It also provides a solution for speakers who travel for their presentations, workshops or lectures and need notes higher than would be available from a standard table height—a solution that can be easily packed for traveling into a small suitcase, briefcase, or computer carrying case. The speaker could bring this portable lectern, rather than depending on the venue to provide such a tabletop lectern.

The embodiments of the invention in which an exclusive property or privilege is claimed are defined as follows:

1. A portable lectern for use as a platform on a supporting surface comprising:

a pair of planar side members each having an upper edge, a lower edge, a rear edge and a front edge;

a top member having a top surface, a bottom surface, a left edge, a right edge and a rear edge;

a planar front member having a rear surface wherein a thickness of said front member is substantially less than a thickness of said side members;

wherein each side member comprises a protrusion extending from a central portion of said upper edge, and said bottom surface of said top member comprises openings corresponding to said side member protrusions that extend partially through the top member; wherein each side member protrusion is located between two inclined portions of said upper edge, said inclined portions extending between said side member protrusion and said respective rear or front edge of said side member;

wherein a length of the side member protrusion taken along the upper edge is greater than a length of each inclined portion, and wherein the side member protrusions fit into said top member openings to releasably secure said bottom surface of the top member to the upper edges of said side members and provide an inclined orientation for the top member;

wherein said rear surface of said front member comprises protrusions and said front edges of said side members comprise openings corresponding to the front member protrusions, wherein the front member protrusions are received in the side member openings to releasably secure the rear surface of the front member to the front edges of the side members; and wherein said front member has a length which is shorter than a length of said front edges of said side members, such that a lower portion of the front edges is exposed when the front member is secured to the side members.

2. The portable lectern of claim 1, wherein said top member comprises a raised protrusion along said rear edge of said top member, wherein the top member protrusion is high enough to provide stability for items placed on said top surface of said top member, helping the items maintain positioning on the top surface of the top member.

3. The portable lectern of claim 2, wherein the length of each side member front edge is greater than a length of said side member rear edge, whereby said top member is inclined toward the rear edges of said side members.

4. The portable lectern of claim 3, wherein said top member, said side members and said front member are each of a size which enables said portable lectern, when disassembled, to fit within a briefcase or carry-on suitcase.

5. The portable lectern of claim 4, wherein no additional connecting devices or tools are required to assemble the portable lectern.

* * * * *